US007410403B1

(12) United States Patent
Altschul

(10) Patent No.: US 7,410,403 B1
(45) Date of Patent: Aug. 12, 2008

(54) HUGGING TOY

(76) Inventor: Randice-Lisa Altschul, 36 Cecilia Ave., Cliffside Park, NJ (US) 07010

( * ) Notice: Subject to any disclaimer, the term of this patent is extended or adjusted under 35 U.S.C. 154(b) by 264 days.

(21) Appl. No.: 11/316,271

(22) Filed: Dec. 22, 2005

(51) Int. Cl.
*A63H 33/00* (2006.01)
*A63H 3/14* (2006.01)
*A63H 3/02* (2006.01)

(52) U.S. Cl. ..... 446/26; 446/328; 446/369

(58) Field of Classification Search ..... 446/26, 446/28, 369, 327, 328
See application file for complete search history.

(56) References Cited

U.S. PATENT DOCUMENTS 2,754,121 A * 7/1956 Jupiter ..... 434/250
2,961,668 A * 11/1960 Hayes ..... 5/640
3,840,916 A * 10/1974 Jennings ..... 5/655
3,883,906 A * 5/1975 Sumpter ..... 5/632
4,300,307 A * 11/1981 Biasuzzi et al. ..... 446/328
4,681,555 A 7/1987 Natiw
4,790,042 A * 12/1988 Reich ..... 5/655
4,799,889 A * 1/1989 Yockey ..... 434/112
D305,288 S * 1/1990 Eldridge ..... D6/598
4,980,929 A 1/1991 Long
5,117,507 A 6/1992 Long
5,209,691 A * 5/1993 Ekstein ..... 446/28
5,643,037 A * 7/1997 Altschul ..... 446/28
6,494,532 B1 * 12/2002 Brosnan et al. ..... 297/181

* cited by examiner

*Primary Examiner*—Gene Kim
*Assistant Examiner*—Alyssa M Hylinski
(74) *Attorney, Agent, or Firm*—Arthur Jacob

(57) ABSTRACT

A hugging toy includes a figure having flexible, sleeve-like limbs providing passages for receiving the arms of a person within the limbs to enable the figure to be drawn into juxtaposition with the person, with the limbs wrapped about the person, the passages each having an entry opening for receiving an arm of the person within the passage, and an exit opening for exposing a hand of the person so as to establish a simulated mutual hugging arrangement between the figure and the person.

4 Claims, 2 Drawing Sheets

HUGGING TOY

The present invention relates generally to playthings and pertains, more specifically, to a hugging toy for being held by a person in a simulated hugging arrangement.

Among the most popular playthings available to people of all ages are stuffed toys, usually in the form of plush figures of animals and the like. Teddy bears long have been essentially staple items in the world of toys and have been made available in a myriad of shapes, sizes and materials, all to the delight of those people engaged in playing with such playthings.

One of the delights realized when playing with a stuffed toy of the type described above is the satisfaction derived merely from hugging the toy. The present invention provides increased satisfaction in that a toy figure constructed in accordance with the present invention appears to hug back. That is, a person upon engaging the plaything in a hugging arrangement receives a simulated hug in return. As such, the present invention attains several objects and advantages, some of which are summarized as follows: Enables a person of almost any age to engage a plaything in a hugging arrangement and obtain a simulation of a return hug; provides a stuffed toy or the like with a construction which allows a delightful interaction between a plaything and a person playing with the plaything; simulates a mutual hugging arrangement between a toy figure and a person; increases satisfaction gained from playing with a stuffed toy or the like; enables stuffed toys of a wide variety of shapes and sizes to be manipulated for greater comfort and increased amusement during play; widens the range of play made available by stuffed toys and the like.

The above objects and advantages, as well as further objects and advantages, are attained by the present invention which may be described briefly as a hugging toy for being held by a person in a simulated hugging arrangement wherein the hugging toy and the person appear to be hugging one another, the hugging toy comprising: a figure having a torso and limbs extending from the torso, each limb having a near end integral with the torso and a far end remote from the near end; at least one of the limbs having an entry opening adjacent the far end of the one limb, an exit opening adjacent the near end, and a passage extending from the far end to the near end; the one limb being flexible and the passage being dimensioned and configured for receiving an arm of a person, with the arm of the person extending into the entry opening, through the passage and out of the exit opening such that upon juxtaposition of the torso of the figure with the person, and with the arm of the person extending through the passage and into a hugging arrangement with the torso, the limb will conform to placement of the arm of the person and the figure will appear to be hugging the person.

The invention will be understood more fully, while still further objects and advantages will become apparent, in the following detailed description of a preferred embodiment of the invention illustrated in the accompanying drawing, in which.

Figure 1:
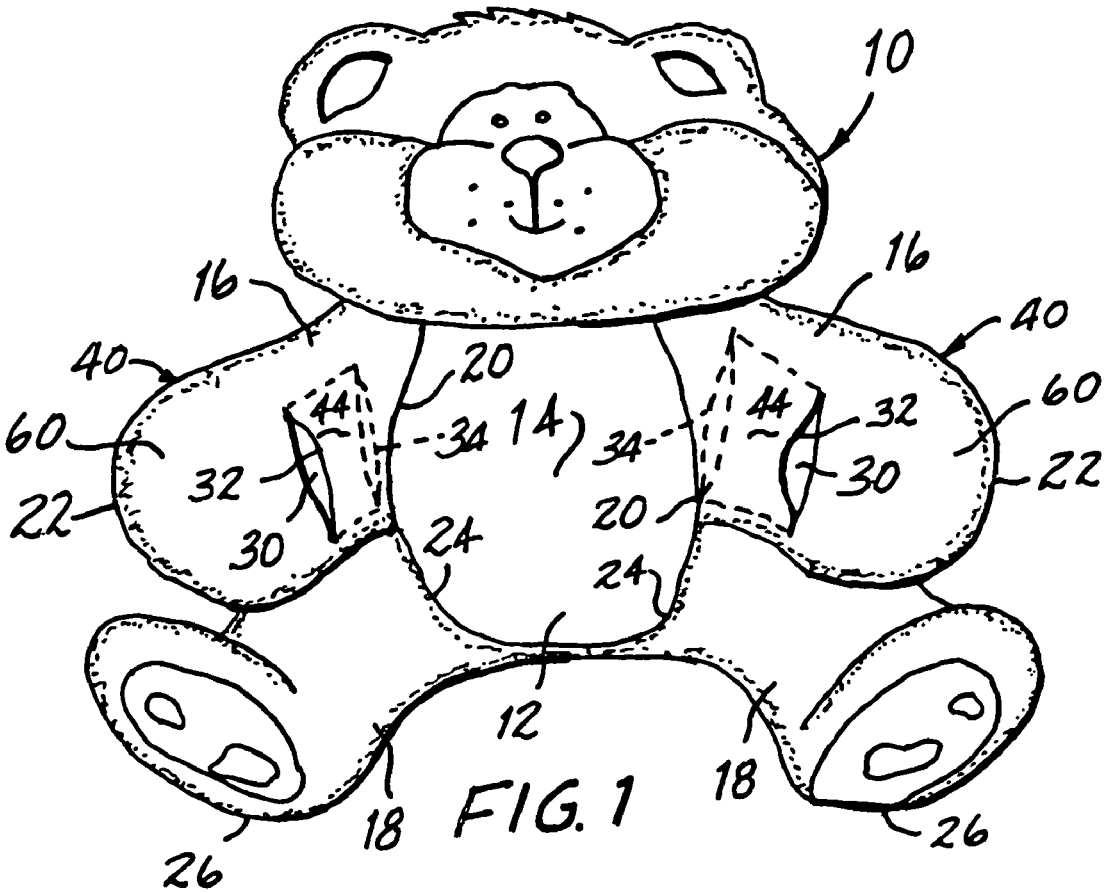
FIG. 1 is a front elevational view of a hugging toy constructed in accordance with the present invention.
Figure 2:
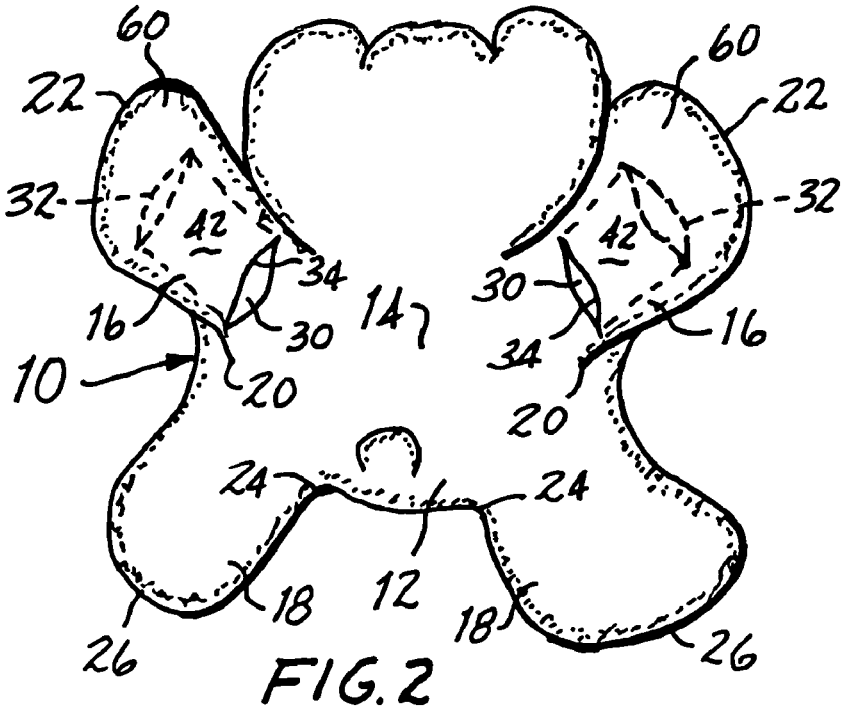
FIG. 2 is a rear elevational view of the hugging toy.

Referring now to the drawings, and especially to FIGS. 1 and 2 thereof, a hugging toy constructed in accordance with the present invention is illustrated at 10, and is seen to be in the form of a plush stuffed animal of the type known as a teddy bear. As such, toy 10 includes a FIG. 12 having a torso 14 and limbs in the form of arms 16 and legs 18 extending from the torso 14, all arranged to resemble a bear.

Arms 16 are integral with torso 14 at a near end 20 of each arm 16, and extend to a far end 22 remote from a corresponding near end 20. Likewise, legs 18 are joined with torso 14 at a near end 24 of each leg 18, and extend to a far end 26 remote from a corresponding near end 24. In the preferred construction, each arm 16 includes an internal passage 30 extending along the arm 16 from an entry opening 32 located adjacent the far end 22 of the arm 16 to an exit opening 34 located adjacent the corresponding near end 20. Each arm 16 has an exterior surface 40 which includes a lateral surface 42 and a medial surface 44, located opposite to the lateral surface 42, the lateral and medial surfaces 42 and 44 extending along the exterior surface 40 between the near end 20 and the far end 22 of the arm 16. The entry opening 32 is located at the medial surface 44 and the exit opening 34 is located at the lateral surface 42, and each opening 32 and 34 communicates with the internal passage 30, for purposes to be described below.

Figure 3:
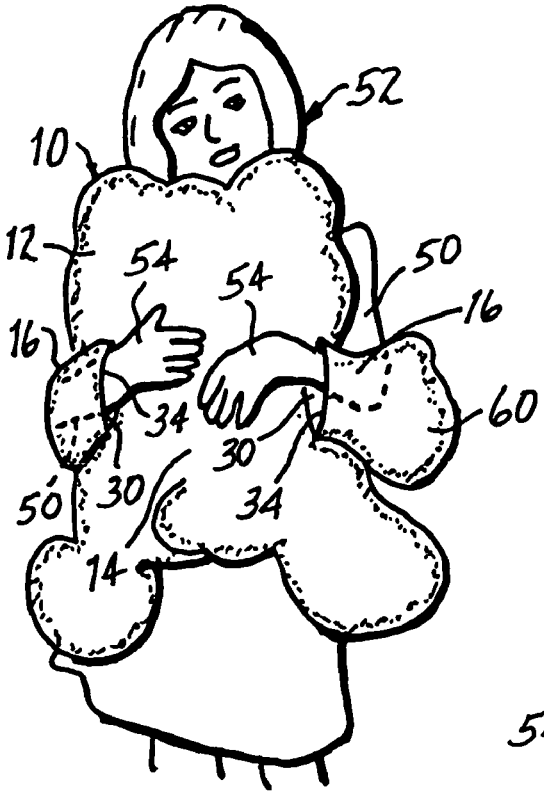
FIG. 3 is a front pictorial view showing the hugging toy in use during play.
Figure 4:
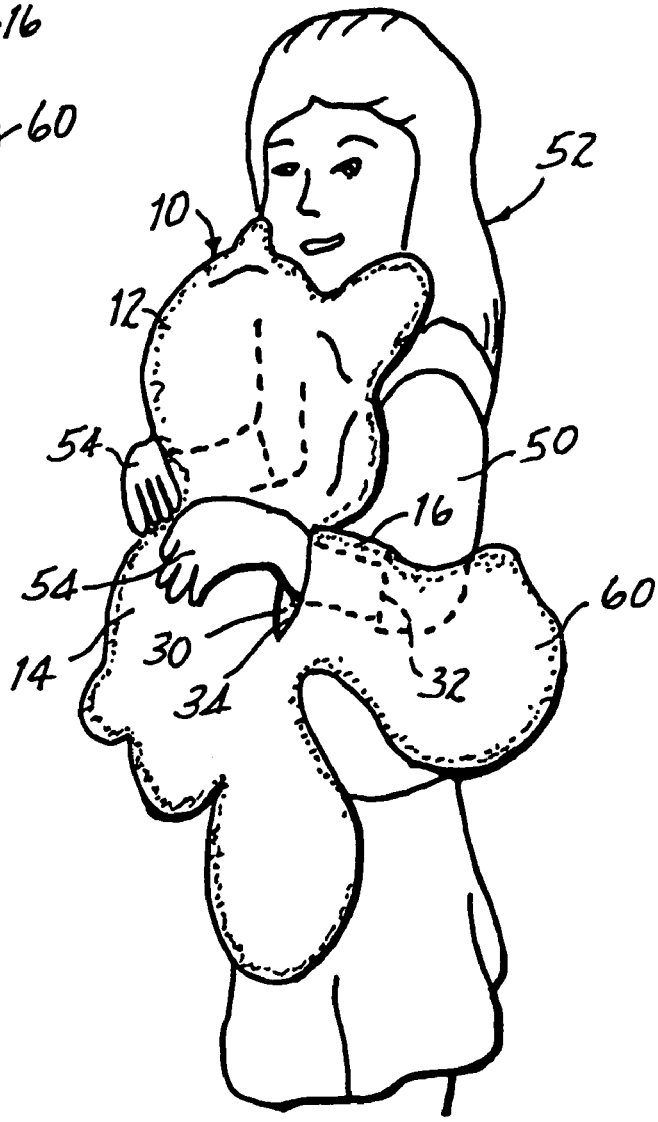
FIG. 4 is a front and side pictorial view showing the hugging toy in use during play.

Turning now to FIGS. 3 and 4, the passage 30 of each arm 16, as well as the corresponding entry and exit openings 32 and 34, are dimensioned and configured for receiving the arms 50 of a person 52, with each arm 50 passing into a counterpart passage 30 through a corresponding entry opening 32 and extending along the passage 30 and out through a corresponding exit opening 34. The arms 16 are flexible, and the sleeve-like construction provided by the passage 30 and the openings 32 and 34 enable the arm 50 of the person 52 to pass through the passage 30, along the length of the arm 16, exposing the hands 54 of the person 50, as illustrated in FIGS. 3 and 4. The person 50 then is able to draw the torso 14 toward the person 50 and into juxtaposition with the person 50, with the arms 16 wrapped about the person 50, thereby placing the FIG. 12 in a simulated mutual hugging arrangement with the person 50. The flexibility of the arms 16, coupled with the location of the entry and exit openings 32 and 34 relative to the passage 30 and to one another, enables the arms 16 to conform to the placement of the arms 52 of the person 50 for wrapping the arms 16 about the person 50, and the location of the exit openings 34 allow exposure of the hands 54 of the person 50, so that the FIG. 12 appears to be hugging the person 50 and the person appears to be hugging the FIG. 12, as shown.

The simulated hug is enhanced by spacing the entry opening 32 from the far end 22 so as to provide an extremity adjacent the far end 22, located between the entry opening 32 and the far end 22, the extremity being shown in the form of a paw 60 of the simulated bear of the FIG. 12. Paw 60 thus extends beyond entry opening 32 and appears to wrap around and grasp the person 50 in a manner similar to the way in which the hands 54 of the person 50 grasp the torso 14 of the FIG. 12. Thus, a simulated mutual hug is established between the FIG. 12 and the person 50 for providing a delightful interaction between the person and the plaything.

It will be seen that the present invention attains all of the objects and advantages summarized above, namely: Enables a person of almost any age to engage a plaything in a hugging arrangement and obtain a simulation of a return hug; provides a stuffed toy or the like with a construction which allows a delightful interaction between a plaything and a person playing with the plaything; simulates a mutual hugging arrangement between a toy figure and a person; increases satisfaction gained from playing with a stuffed toy or the like; enables stuffed toys of a wide variety of shapes and sizes to be manipulated for greater comfort and increased amusement during play; widens the range of play made available by stuffed toys and the like.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A hugging toy for being held by a person in a simulated hugging arrangement wherein the hugging toy and the person appear to be hugging one another, the hugging toy comprising:

a figure having a torso and limbs extending from the torso, each limb having a near end integral with the torso and a far end remote from the near end, the figure including a lateral surface and a medial surface, each extending along at least one limb;

the at least one limb having an entry opening adjacent the far end of the one limb, an exit opening adjacent the near end, and a passage extending from the far end to the near end, the entry opening being located at the medial surface and the exit opening being located at the lateral surface;

the one limb being flexible and the passage being dimensioned and configured for receiving an arm of a person, with the arm of the person extending into the entry opening, through the passage and out of the exit opening, and an extremity located on the one limb between the entry opening and the far end of the one limb such that upon juxtaposition of the torso of the figure with the person, and with the arm of the person extending through the passage and into a hugging arrangement with the torso, the limb will conform to placement of the arm of the person and the extremity will appear to wrap around and grasp the person so that the person and the figure will appear to be hugging one another.

2. The hugging toy of claim 1 wherein the figure comprises a simulated animal configuration and the extremity comprises a paw.

3. The hugging toy of claim 1 wherein the lateral surface and the medial surface each extend along two limbs, an entry opening is located at the medial surface of each limb, and an exit opening is located at the lateral surface of each limb, the hugging toy including an extremity located on each limb between a corresponding entry opening and a corresponding far end of each limb.

4. The hugging toy of claim 3 wherein the figure comprises a simulated animal configuration and each extremity comprises a paw.

* * * * *